US011338349B2

(12) United States Patent
Pastor Salvador et al.

(10) Patent No.: US 11,338,349 B2
(45) Date of Patent: May 24, 2022

(54) LOADING DIES IN A PRESS

(71) Applicant: ABB SCHWEIZ AG, Baden (CH)

(72) Inventors: Carlos Pastor Salvador, Barcelona (ES); Mikel Bernal Franco, Hendaye (FR)

(73) Assignee: ABB Schweiz AG, Baden (CH)

( * ) Notice: Subject to any disclaimer, the term of this patent is extended or adjusted under 35 U.S.C. 154(b) by 420 days.

(21) Appl. No.: 15/748,448

(22) PCT Filed: Jul. 29, 2015

(86) PCT No.: PCT/EP2015/067434
§ 371 (c)(1),
(2) Date: Jan. 29, 2018

(87) PCT Pub. No.: WO2017/016603
PCT Pub. Date: Feb. 2, 2017

(65) Prior Publication Data

US 2018/0221935 A1 Aug. 9, 2018

(51) Int. Cl.
*B21D 37/14* (2006.01)

(52) U.S. Cl.
CPC ..... *B21D 37/14* (2013.01)

(58) Field of Classification Search
CPC ..... B21D 5/0254; B21D 22/06; B21D 22/08; B21D 37/12; B21D 37/145; B21D 37/147;
(Continued)

(56) References Cited

U.S. PATENT DOCUMENTS 4,587,716 A 5/1986 Bytow
4,597,709 A * 7/1986 Yonezawa ..... B21D 37/14 104/307
(Continued)

FOREIGN PATENT DOCUMENTS

CN 103459059 12/2013
EP 0128487 A1 12/1984
(Continued)

OTHER PUBLICATIONS

International Search Report and Written Opinion of the International Searching Authority, International Application No. PCT/EP2015/067434 issued by the European Patent Office dated Apr. 20, 2016, 12 pages, Rijswijk, Netherlands.

*Primary Examiner* — Adam J Eiseman
*Assistant Examiner* — Stephen Floyd London
(74) *Attorney, Agent, or Firm* — Peter B. Scull; EIP US LLP

(57) ABSTRACT

Systems and methods for loading and/or unloading a die in a press are disclosed. A handling system for loading a die may include a linear sliding path between a supply position outside the press and a press position on the press base, configured to support a die such that the die is displaceable while it is supported on the path, and a robot configured to displace the die between the supply position and the press position along the linear sliding path. A method may include providing a robot for loading workpieces in the press, providing a linear sliding path between a supply position outside the press and a press position on the press base, placing a die in the supply position, and causing the robot to displace the die on the linear sliding path, from the supply position to the press position.

8 Claims, 4 Drawing Sheets

(58) Field of Classification Search
CPC . B21D 43/105; B21D 43/08; Y10T 483/1729; Y10T 483/1731; B23Q 3/15573; B23Q 3/1572; B23Q 3/15722; B23Q 7/045; B23Q 7/046; B23Q 1/40
USPC ..... 438/28, 29; 198/717–749
See application file for complete search history.

(56) References Cited

U.S. PATENT DOCUMENTS 5,120,179 A 6/1992 Henderson et al.
5,337,594 A * 8/1994 Pettersson ..... B30B 15/028 72/446
5,582,062 A 12/1996 Sommer
5,882,285 A * 3/1999 Seto ..... B21D 28/12 483/29
6,013,017 A * 1/2000 Aizawa ..... B21D 28/246 483/29
6,126,582 A * 10/2000 Dangelmayr ..... B21D 43/057 483/28
2001/0029225 A1* 10/2001 Kawamoto ..... B21D 37/14 483/29
2004/0018925 A1* 1/2004 Harsch ..... B21D 43/057 483/28
2006/0160684 A1* 7/2006 Springston ..... B29C 31/006 483/1
2009/0126452 A1 5/2009 Toeniskoetter
2011/0151044 A1* 6/2011 Kato ..... B21D 37/14 425/183
2012/0260711 A1* 10/2012 Ikeda ..... B21D 39/021 72/252.5
2013/0310236 A1* 11/2013 Kojima ..... B21D 37/14 483/28
2017/0015014 A1* 1/2017 Hoover ..... B26D 5/02
2018/0021839 A1* 1/2018 Lee ..... B21D 37/14 72/349
2018/0056357 A1* 3/2018 Kubinger ..... B21D 5/0281

FOREIGN PATENT DOCUMENTS

JP S57199523 A 12/1982
JP H06142996 A 5/1994
JP 2014004604 A 1/2014
WO WO2014002569 A1 1/2014

* cited by examiner

LOADING DIES IN A PRESS

The present disclosure relates to systems and methods for loading or for replacing dies in a press.

BACKGROUND

Press lines for the production of small parts or objects, for example telephone cases, housings for television sets and many others, may include several presses, each provided with a suitable forming die, which perform successive cutting and/or shaping operations on a blank or workpiece to give it the desired final configuration. The presses employed in such press lines may for example be C-frame presses.

The press lines may be provided with robots, for example serial robots with 4 axes or more, for transferring the workpieces, i.e. blanks or semi-formed parts, from one press to another. These robots may be relatively small, since they handle low weight workpieces and parts.

Each part or object to be manufactured in the press line requires a respective set of dies. Consequently, the dies of at least some of the presses of the line must be removed and replaced each time a new part or object is to be produced in the press line. The dies are much heavier than the workpieces and parts being manufactured; for example, a typical die for a part having a size of about 40×40 cm can have a weight of 1000 Kg.

In order to perform the replacement, operators using forklifts or the like may unload existing dies from the presses, take them to a storing space, fetch the new dies, and load them to the presses. This is time consuming and requires operators to be available at the right moment, and therefore it is not efficient and involves long downtimes for the line.

Another known die replacement system involves attaching to each press a pair of consoles, provided with rolling elements such as steel balls, and drive units e.g. one or more pistons. A new die to be loaded in a press is placed on the pair of consoles using e.g. a crane or a forklift truck, and displaced to the right position in the press by the drive unit. The existing die is previously unloaded from the press in using the same consoles and drive unit.

However, this requires providing not only the consoles and rolling elements but also the drive unit(s), which in addition must be connected to a power source.

It might be desirable to provide a simpler solution for the loading and unloading of dies, that allows reducing the downtime and the effort required for the operation and, hence, allows decreasing the cost and increasing the productivity.

SUMMARY

According to a first aspect, the present disclosure is related to a handling system for loading a die in a press, wherein the handling system includes:

- a robot, and
  - a first linear sliding path between a supply position outside the press and a press position on the press base, the first linear sliding path being configured to support a die such that the die is displaceable while it is supported on the path,
- wherein the robot is configured to displace the die between the supply position and the press position along the first linear sliding path, while it is supported on the path.

The use of robots for loading dies in a press allows automated loading of the dies without the need of external or additional driving units, by employing the robots that are already present in a press line for serving each press, i.e. the robots that feed workpieces to the press. Consequently, it provides an efficient and cost-effective solution for handling the dies.

Employing robots for loading the dies is also a particularly versatile solution: while other driving units are limited to very simple movements, robots can be programmed to perform any movement to bring a die from a suitable position in the vicinity of a press to the press position, and therefore allows choosing different initial positions from which the dies are to be automatically loaded in the press, depending on the needs of each particular press line or press.

Furthermore, dies may be provided at the initial positions in the vicinity of the presses during the normal manufacturing operation of the press line, such that when the press line completes a manufacturing batch and has to be prepared to manufacture a different object or part, and a die needs to be loaded in the presses, this step can be done without the intervention of human operators and only requires a minimum downtime.

Even though the robots that feed workpieces to presses in the production of small parts or objects are relatively small, due to the low weight of the parts to be handled, while the dies for these lines generally have a higher weight that the robots could not handle, this problem is solved by the provision of suitable sliding paths on which the die is supported during the loading operation, such that the robot does not need to lift the die, and only needs to displace it horizontally. The weight of the dies is supported by the sliding path.

By sliding path it is herein intended a path that is configured to reduce the friction between the die and the surfaces on which the die has to move, and therefore to allow it to slide. In some examples the path may include for example rolling elements such as bearing balls or bearing rollers, but also other solutions such as surfaces made of a low friction material that facilitates sliding of the die thereon, conveyor belts mounted on idle pulleys, etc.

According to another aspect, the disclosure is related to a press line including at least one press and a handling system as disclosed above, in which the robot of the handling system is also the robot for loading workpieces in the press.

BRIEF DESCRIPTION OF THE DRAWINGS

Non-limiting examples of the present disclosure will be described in the following, with reference to the appended drawings, in which.

DETAILED DESCRIPTION OF EXAMPLES

Figure 1:
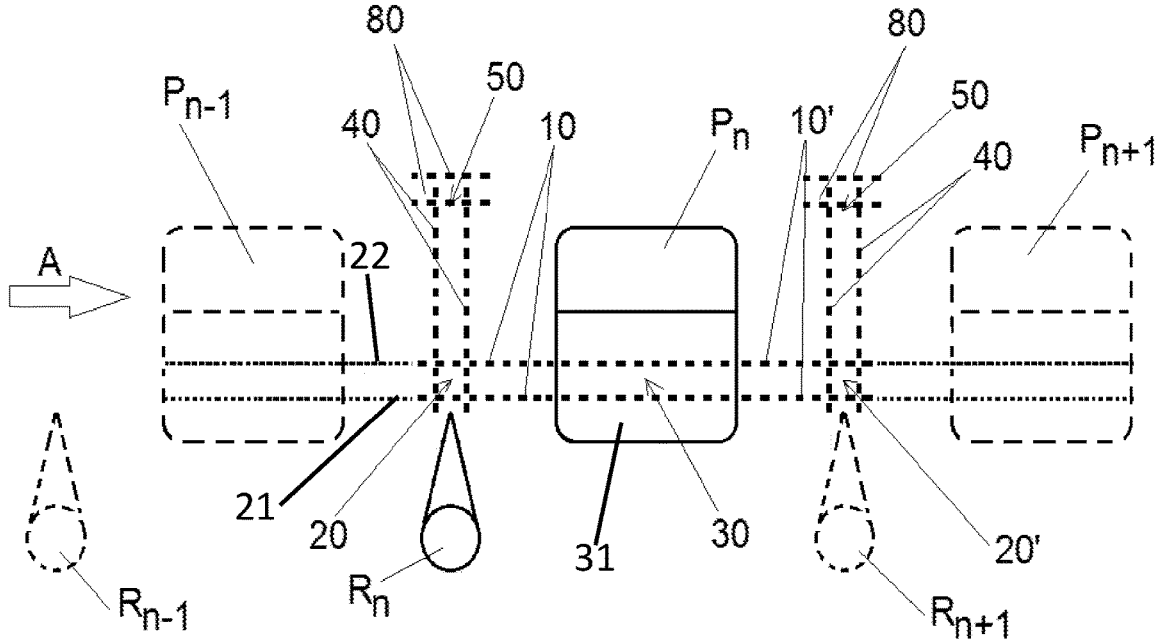
FIGS. 1, 2 and 3 schematically show in plan view several examples of a handling system for loading a die in a press as disclosed herein.

FIG. 1 shows very schematically in plan view a press $P_n$ in a press line. Part of the press line is sketched in dotted lines at both sides of press showing presses $P_{n-1}$ and $P_{n+1}$, respectively upstream and downstream of press $P_n$ in the direction of advance of a workpiece along the line.

Robots $R_n$, $R_{n-1}$ and $R_{n+1}$ are arranged in the press line for transferring workpieces (not shown) from one press to another during a manufacturing operation: for example robot $R_n$ may remove workpieces from press $P_{n-1}$ and feed them to press $P_n$. Suitable robots for such an operation may be for example models IRB1200, IRB1400, IRB1600 or IRB4600, available from ABB (www.abb.com), amongst others.

FIG. 1 also shows very schematically a first example of a handling system for loading a die (not shown) in press $P_n$. A die to be employed in a press usually includes an upper die member and a lower die member. The assembly of the upper and lower die members is loaded in the right position in the press, and then the die members are each attached in known manner to the press ram and press base. In the present specification, the expression "a die" is intended to include such a die having an upper die member and a lower die member, which are loaded to the press and unloaded from the press as an assembly.

In the example of FIG. 1, the handling system for loading a die includes the robot $R_n$ and a linear sliding path 10 between a supply position 20 outside the press and a press position 30 on the press base 31. The robot $R_n$ may be programmed to displace a die between the supply position 20 and the press position 30 along the linear sliding path 10, while it is supported by the path 10 itself.

In some examples the robot $R_n$ may engage a side surface or a top surface of the die at the supply position 20, and push it along the path 10 until it reaches the press position 30, where the upper die member and the lower die member may be clamped or otherwise fixed in position in the press, as known.

The robot may engage the die in several possible ways, depending on the requirements of each case. For example, the robot wrist may be rotated such that the tooling for picking the workpieces during normal operation is moved out of the way, and the robot wrist itself may engage the die; alternatively, the tooling may be changed, and a tooling suitable to engage the die may be mounted on the robot before the die loading operation.

In some examples the robot wrist and/or the die may be provided with suitable mechanical parts for a mutual engagement that allow the robot to push and/or pull the die; in other examples, the robot wrist may be provided with an electromagnet to be temporarily attached to the die.

In examples wherein the robot only needs to push the die, the robot wrist or tooling may simply be brought in contact with a suitable point of the die without being attached to it.

Figure 4:
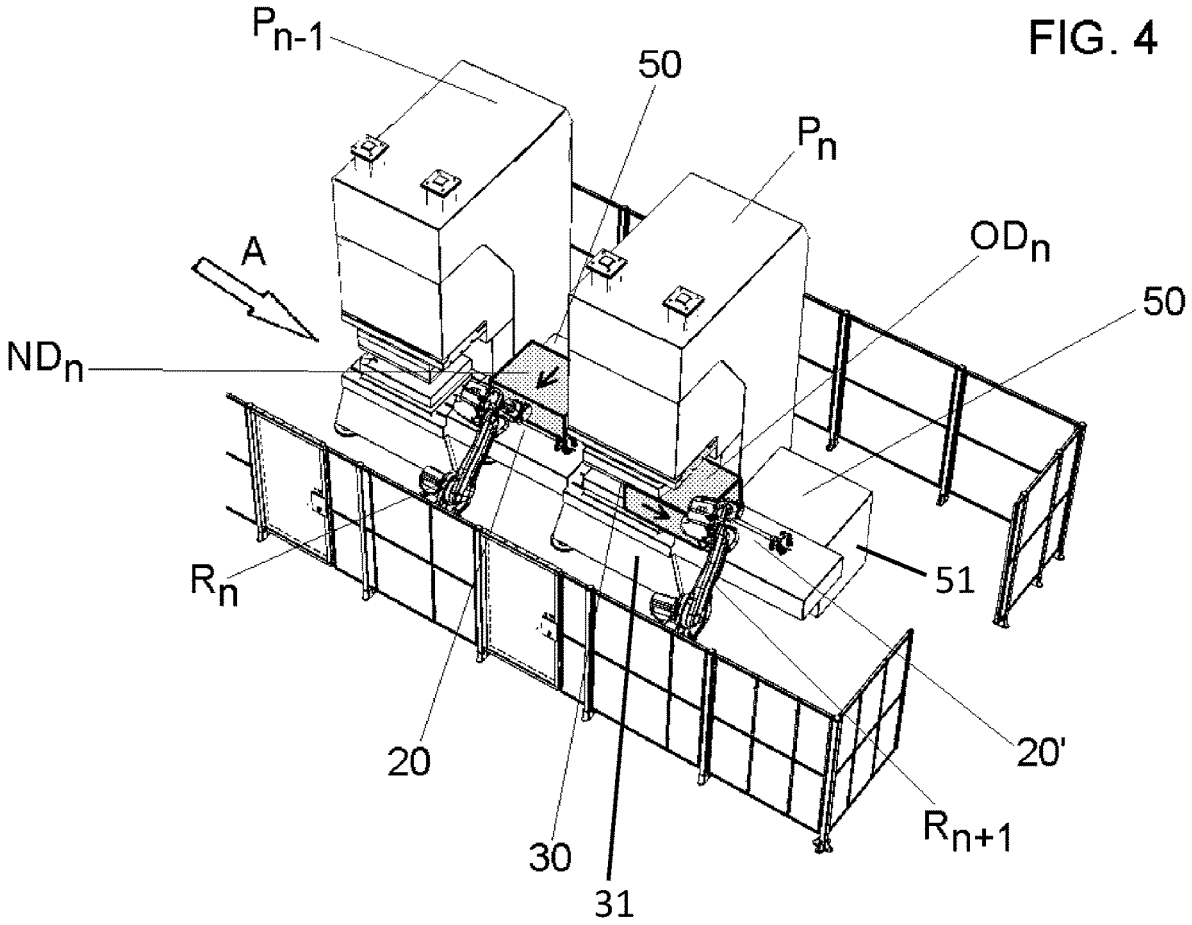
FIG. 4 shows schematically in perspective view an example press line in which an implementation of a system as disclosed herein is employed.
Figure 5:
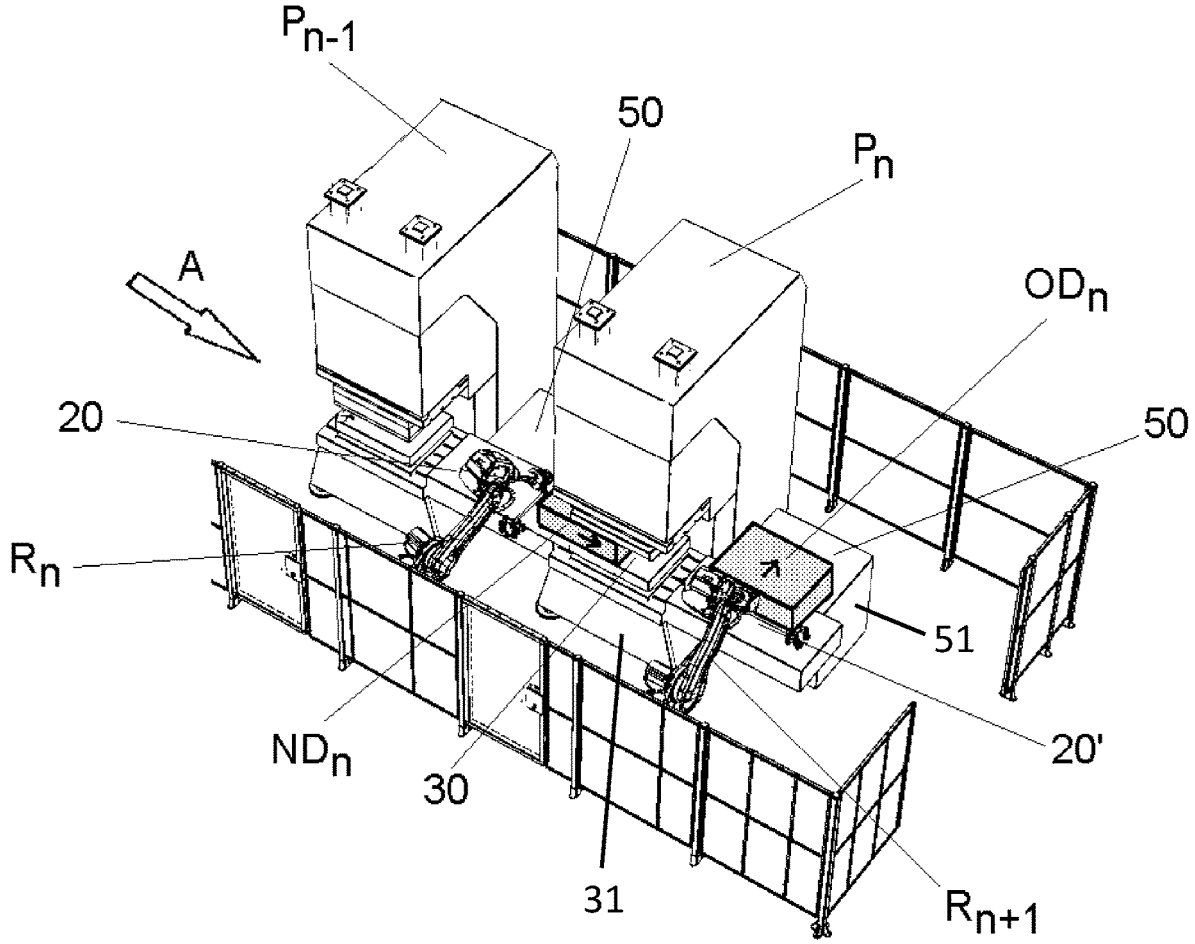
FIG. 5 is another view of the press line of FIG. 4, in a different moment of a die loading and unloading operation.

FIGS. 4 and 5 are perspective views of a press line such as that of FIG. 1, in two different moments of the process of replacing the dies of the presses to change from a manufacturing batch of a certain part, such as a telephone casing, to a manufacturing batch of a different part. The path 10 has not been depicted in FIGS. 4 and 5 to avoid confusion: it will be understood that it is substantially parallel to the direction of advance of the workpieces in the press line, indicated by arrow A, and extends between the press position 30 on the base of the press $P_n$ and the supply position 20 between presses $P_{n-1}$ and $P_n$.

In FIGS. 4 and 5, a die $OD_n$ that has been used in press $P_n$ during a completed manufacturing batch is being unloaded from the press $P_n$ by robot $R_{n+1}$, and a new die $ND_n$ that will be used in the same press $P_n$ in the next manufacturing batch is being loaded to press $P_n$ by robot $R_n$. The complete operation illustrated by FIGS. 4 and 5 will be described with more detail later on.

The linear sliding path 10 is configured in such a way that it can support a die allowing it to slide, such that the die is displaceable while it is resting on the path. The path may include for example a plurality of bearing balls, or bearing rollers, which may be arranged on two parallel lines as depicted in FIG. 1.

The rolling elements 21, 22 such as balls or rollers of the path 10 protrude upwards from an underlying surface, so a die may rest on them. In some parts of the path the underlying surface is the press base, for example in the press position 30. In other parts of the path the underlying surface may be any frame part or auxiliary support surface of the press line, for example in the supply position 20.

In some examples, at least some portions of the sliding path 10 may be movable vertically between a higher, active position, in which the ball bearings or other elements protrude upwards from the underlying base 51, and an inactive position, in which they remain flush with the underlying base 51, or at a lower level. In the active position the die rests on the elements of the path 10 and can be displaced easily; once the die has been placed in the desired position, the path 10 may be shifted to the lower, inactive position such that the die also descends until it rests on the underlying, stationary surface. The surfaces underlying the path 10 may be provided with suitable grooves, recesses etc. to arrange the path elements and allow this operation.

The example of FIG. 1 shows that the handling system may include another linear sliding path 40, which may have a configuration similar to that described for path 10, or a different one.

Sliding path 40 extends between the supply position 20 and a waiting position 50, which like position 20 is outside the press, where a die may be placed, for example by a forklift truck, crane or the like, during a normal manufacturing process of the press line.

As shown in the figure, the sliding path 40 may be substantially perpendicular to the sliding path 10, and the waiting position 50 may be located between two presses of the line but towards the back side of the presses, and therefore outside the space through which the workpieces are transferred from one press to another by the robots. A die in the waiting position therefore does not interfere with the normal operation of the press line.

It will be understood that providing a waiting position 50, and a sliding path 40 between this position and the supply position 20, allows preparing the die change during the normal manufacturing operation of the line, such that this time does not add to the time needed for the dies change itself, and the downtimes for the die change operation may therefore be reduced. Furthermore, the waiting position 50 may be located such as to facilitate the operations of placement of the die, taking into account the layout and dimensions of the press line, the tools used to transport the die, etc.

Referring to FIGS. 1, 4 and 5, an example of a method for loading a die in a press $P_n$ may therefore include:

- placing a die (not shown in FIG. 1) in the waiting position 50, for example during normal operation of the press line, and then, once the current manufacturing batch is complete,
- engaging the new die at the waiting position with the robot $R_n$, for example on the front side of the die,
- causing the robot to pull the new die to displace it on the linear sliding path 40 until it reaches the supply position 20,
- changing the engagement of the robot with the die if convenient, for example to engage a different side of the die, and pushing the die to displace it on the linear sliding path 10, from the supply position 20 to the press position 30 in press $P_n$.

The old die may be removed or unloaded from the press $P_n$ in the same operation in a way that leaves the press position 30 free to receive the new die, as will be described later on; alternatively, it may be removed before the loading operation of the new die is started.

Figure 2:
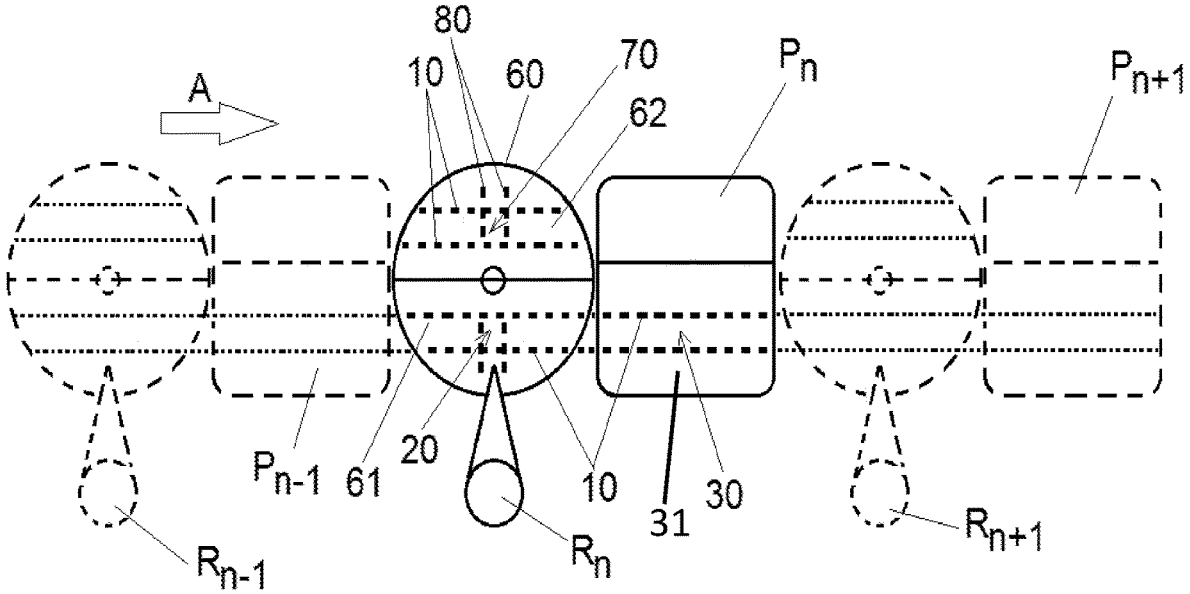

FIG. 2 illustrates very schematically in plan view a press line with a number of presses $P_{n-1}$, $P_n$ and $P_{n+1}$ and with robots $R_n$, $R_{n-1}$ and $R_{n+1}$ for transferring workpieces from one press to another, as in FIG. 1, and another example of a handling system for loading a die (not shown) in a press.

Like in FIG. 1, the handling system shown in FIG. 2 includes the robot $R_n$ and the linear sliding path 10 between a supply position 20 and a press position 30. The supply position 20 is a geometrical position outside the press, for example located in the space between two presses, and substantially aligned with the press position in the direction of advance of the workpieces in the press line, as in FIG. 1.

Furthermore, in the example shown in FIG. 2 the handling system includes a rotatable table 60 with two stations 61, 62 each adapted for receiving a die (not shown). As may be appreciated in the figure, the rotatable table 60 is arranged such that one of its stations may be in the supply position 20. The rotatable table has formed on the stations a portion or length of the sliding path 10, while another portion is formed on a stationary frame between the press and the rotatable table, and another portion is on the press base.

When one station of the table 60 is in the supply position 20, the other station is in a waiting position 70, and the rotatable table 60 may be rotated to move a die (not shown) between the waiting position 70 and the supply position 20.

Figure 3:
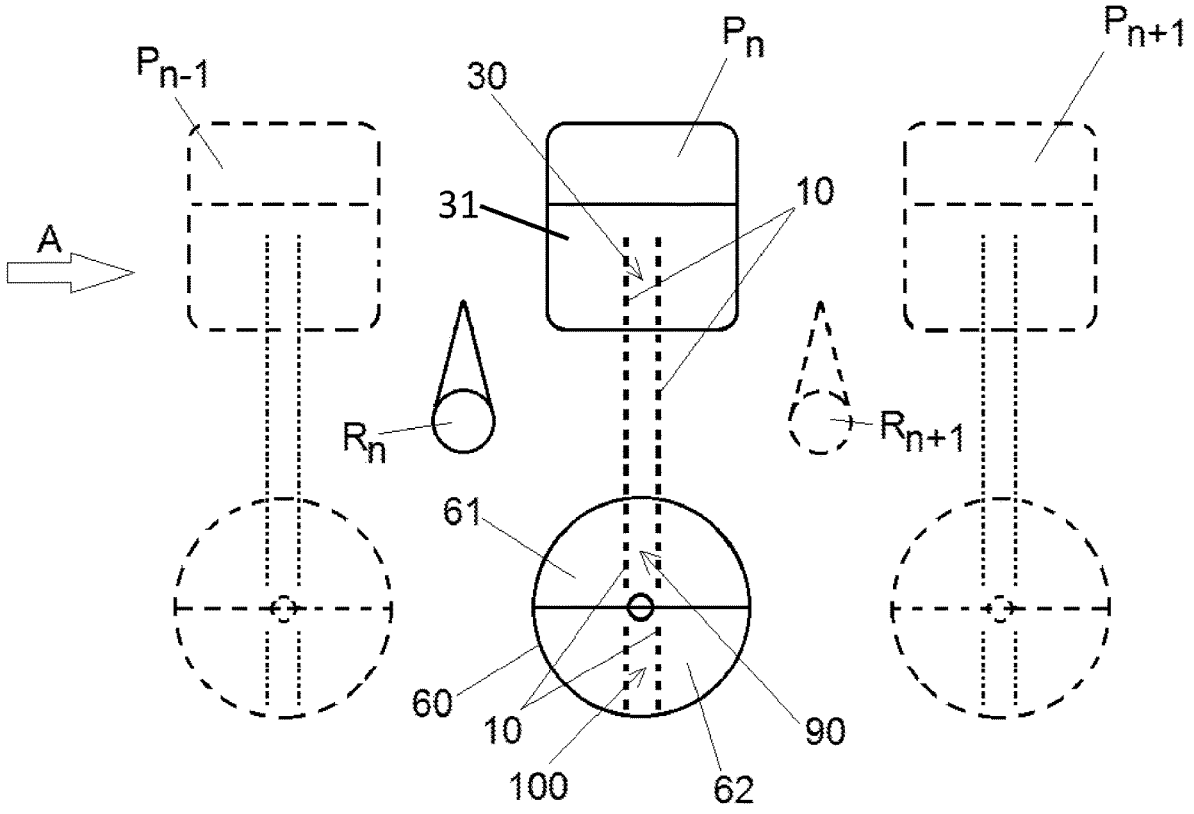

A further example of a handling system according to the present disclosure is illustrated very schematically in plan view in FIG. 3: like FIGS. 1 and 2, in the figure a press line with a number of presses $P_{n-1}$, $P_n$ and $P_{n+1}$ and with robots $R_n$, $R_{n-1}$ and $R_{n+1}$ for transferring workpieces from one press to another.

The handling system shown in FIG. 3 also includes the robot $R_n$, and a linear sliding path 10 between a supply position 90 and a press position 30, which in this case is not in the direction of advance of the workpieces through the press line but in a perpendicular direction. The supply position 90 is therefore a geometrical position outside the press, but it is not located in the space between two presses as in FIGS. 1 and 2, but in the space in front of the press $P_n$.

In the example shown in FIG. 3 the handling system also includes a rotatable table 60 with two stations 61, 62 and arranged such that one of its stations may be in the supply position 90. Like in FIG. 2, the rotatable table has formed on the stations a portion or length of the sliding path 10, while another portion is formed on a stationary frame between the press and the rotatable table, and another portion is on the press base.

When one station of the table 60 is in the supply position 90, the other station is in a waiting position 100, and the rotatable table 60 may be rotated to move a die (not shown) between the waiting position 90 and the supply position 100.

In the examples of FIGS. 2 and 3 a method for loading a die in a press $P_n$ may therefore include:

placing a die (not shown) on the station of the rotating table 60 that is in the waiting position 70 or 100, for example during normal operation of the press line, and then, once the current manufacturing batch is complete, rotating the rotatable table 60 such that the die is moved from the waiting position to the supply position 20 or 90, causing the robot $R_n$ to engage the die and displacing it on the linear sliding path 10 from the supply position 20 or 90 to the press position 30 in press $P_n$.

In some examples, the handling system may also include a centering system (not shown) for the die, for example suitable abutments, at the waiting position 50, 70 or 100. In the examples of FIGS. 2 and 3 each station of the rotatable table 60 may include such a die centering system. An operator can therefore accurately place the die on the station 62, in the waiting position 70 or 100. Since the die is in a precise and known position, when the table 60 is rotated and the die comes to be in the supply position 20 or 90, the robot $R_n$ can engage it and displace it towards the press position 30 accurately.

In some embodiments, a short additional linear sliding path 80 may be provided at the waiting position, perpendicular to the main sliding path existing at this position, to assist in placing and centering the die accurately.

For example, such a short additional sliding path 80 may be provided in FIG. 1 at waiting position 50, perpendicular to path 40; or in FIGS. 2 and 3 a short path 80 may be provided on each station 61, 62 of the rotatable table 60, perpendicular to path 10, so that it is available at waiting positions 70 or 100.

A fine centering system may also be provided in any of the above examples in the press position 30 on the press base, in order to correct potential positioning errors of the die in the waiting position and/or arising during its travel.

A handling system according to the present disclosure may also be employed for unloading a die from a press.

In order to unload a die from the press $P_n$ in the implementations of FIGS. 1 and 2, for example, another linear sliding path 10' may be provided between the press position 30 on the press base and a discharge position 20' outside the press, in this case downstream of the press $P_n$ itself, and the robot $R_{n+1}$ may be employed to engage a die in the press position 30 and displace it to the discharge position 20' on the sliding path 10'.

In the examples of FIGS. 1 and 2 the path 10' is aligned with the path 10 (located upstream of the press $P_n$) that has been described above and that is employed for loading the die. It will be appreciated that the discharge position 20' for press $P_n$ may be the same position as the supply position 20 for loading the die in the next press $P_{n-1}$ of the line.

In the example of FIGS. 1, 4 and 5, the robot $R_{n+1}$ may also displace the die from the discharge position 20' (or supply position 20) to the waiting position 50 over the sliding path 40, wherein robot $R_{n+1}$, path 40 and position 50 may at the same time be part of the handling system for loading a die to press $P_{n+1}$.

It will therefore be understood that, in examples such as shown in FIGS. 1, 4 and 5, a method for loading and unloading dies from presses in a press line, such as $P_{n-1}$, $P_n$ and $P_{n+1}$, may include loading dies in each press and unloading dies from each press with methods as disclosed above in relation to FIG. 1 or 2, wherein each robot such as $R_n$ unloads dies from the press $P_{n-1}$ arranged immediately upstream of it in the press line, and loads dies in the press $P_n$ arranged immediately downstream of it in the press line, and wherein the supply position 20 corresponding to one press $P_n$ is the same as the discharge position 20' of the press $P_{n-1}$ immediately upstream in the press line.

FIGS. 4 and 5 best illustrate such a method for loading and unloading dies.

In FIG. 4, downstream of the press $P_n$, robot $R_{n+1}$ is displacing the old die $OD_n$ from the press position 30 in press $P_n$ towards the discharge position 20' on sliding path 10'. Simultaneously, upstream of the press $P_n$, robot $R_n$ is displacing the new die $ND_n$ on sliding path 40 from the waiting position 50 to the supply position 20.

In FIG. 5, which corresponds to a later time, robot $R_{n+1}$ is displacing the old die $OD_n$ from the discharge position 20' towards the waiting position 50 downstream of the press $P_n$, on sliding path 40. Simultaneously, upstream of the press $P_n$, robot $R_n$ is displacing the new die $ND_n$ on sliding path 10 from the supply position 20 to the press position 30 in the press $P_n$.

A similar method may be performed for example in an example such as shown in FIG. 2, except that the displacement between the waiting position 70 and the supply position 20, as well as the displacement between the discharge position 20' and the waiting position 70, are performed by turning 180° the rotatable table 60, instead of being performed by the robots.

In order to change the dies in the presses of all the line, and during a normal manufacturing operation of the press line, new dies are prepared at the waiting positions upstream of each press of the line, such that there is an empty waiting position, downstream of the last press.

Once the normal manufacturing operation is finished, the dies in each press are changed as described above, starting with the last press of the line: when the dies of the last press have been changed, there is an empty waiting position between the last press and the next-to-last press, and therefore the dies of the next-to-last press may be changed. The process is repeated until the dies in all the presses have been changed, and the empty waiting position is upstream of the first press of the line. All this process may be performed automatically, without the need of operators intervening at each press.

In a subsequent operation, which can take place while the press line is again performing a normal manufacturing operation, the old dies may be removed from the waiting positions, for example by an operator with a forklift.

In the example of FIG. 2, rotatable tables 60 are shared between two presses, such that the same table is employed for loading the die in one press, and for unloading the die in an adjacent press.

On the contrary, in the example of FIG. 3 each table 60 serves only one press, for both the die loading and the die unloading operations; the discharge position is the same as the supply position 90 for each press, and therefore the sliding path between the press position 30 and the discharge position 90 is the same as the sliding path between the supply position 90 and the press position 30.

Consequently, in the example of FIG. 3, dies may be changed simultaneously in all the presses in the line, but in each press the loading operation of the new die is performed after the unloading operation of the old die, and the same robot may perform all the operations related to one press.

For example, in the case of FIG. 3, in the first place the new dies are prepared in the waiting positions 100 corresponding to each press, during a normal manufacturing operation. Then, simultaneously for all the presses, the old die is displaced by a robot from the press position 30 to the discharge position 90, along path 10; the rotatable table is turned 180°, such that the two dies swap places, the old die being moved to the waiting position 100 and the new die being moved to the supply position 90; and finally, the new die is displaced by the same robot on path 10 from the supply position 90 to the press position 30.

Although only a number of examples have been disclosed herein, other alternatives, modifications, uses and/or equivalents thereof are possible. Furthermore, all possible combinations of the described examples are also covered. Thus, the scope of the present disclosure should not be limited by particular examples, but should be determined only by a fair reading of the claims that follow.

The invention claimed is:

1. A handling system for loading a die in a press, the handling system comprising:

a robot structurally configured for loading workpieces in the press, the robot being a serial industrial robot programmable to one or both move objects in at least two discrete directions or move in four or more axes, and a first linear sliding path between a supply position outside the press and a press position on a press base, the first linear sliding path being configured to support the die such that the die is displaceable while the die is supported directly on rolling elements of the first linear sliding path, the robot structurally configured for loading workpieces in the press being further configured also to displace the die between the supply position and the press position along the first linear sliding path by sliding the die over the rolling elements of the first linear sliding path, while the die is directly supported on the rolling elements of the first linear sliding path;

and, the robot being configured to force loading the workpieces and displacement of the die in the at least two discrete directions;

the handling system further comprising:

a second linear sliding path between a waiting position outside the press and the supply position, the second linear sliding path being configured to support the die such that the die is displaceable while it is resting directly on rolling elements of the second linear sliding path, the second linear sliding path being perpendicular to the first linear sliding path.

2. A handling system according to claim 1, at least a portion of the first linear sliding path being movable between a higher active position in which it protrudes upwards from a stationary underlying base, and a lower inactive position in which it does not protrude from the stationary underlying base.

3. A handling system as claimed in claim 1, the first linear sliding path between the supply position outside the press and the press position on the press base being arranged such that the die in the supply position is accessible by the robot for loading workpieces in the press.

4. A press line comprising at least one press, and a handling system as in claim 1 for loading a die in the at least one press.

5. A press line as claimed in claim 4, the supply position of the first linear sliding path being located at a distance from the robot structurally configured for loading workpieces in the at least one press that is suitable for the robot to engage the die placed in said supply position.

6. A method for loading a die in a press, comprising:

providing a robot structurally configured for loading workpieces in the press, the robot being a serial industrial robot programmable to one or both move objects at least two discrete directions or move in four or more axes, providing a first linear sliding path between a supply position outside the press and a press position on a press base, placing the die in the supply position, directly on rolling elements of the first linear sliding path, the placing of the die in the supply position further comprising:

providing a second linear sliding path perpendicular to the first linear sliding path, between a waiting position and the supply position, placing the die in the waiting position directly on rolling elements of the second linear sliding path, and causing the robot to displace the die on the second linear sliding path by sliding the die over the rolling elements of the second linear sliding path, from the waiting position to the supply position, and causing the robot structurally configured for loading workpieces in the press to displace the die on the first linear sliding path by sliding the die over the rolling elements, from the supply position to the press position; and, causing the robot to force loading the workpieces and displacement of the die in at least the two discrete directions.

7. A method as claimed in claim 6, further comprising unloading the die from the press, the unloading comprising:

providing a third sliding path in a linear direction between the press position on the press base and a discharge position outside the press, and causing the robot to displace the die on the third sliding path from the press position to the discharge position.

8. A method as claimed in claim 7, applied in a press line, the press line comprising at least two presses, each press of the at least two presses of the press line comprising a corresponding robot structurally configured for loading workpieces in each press, each robot being configured for unloading dies from a first press arranged immediately upstream of each respective robot in the press line and loading dies in a second press arranged immediately downstream of each robot in the press line, and a supply position corresponding to one press being the same as a discharge position of the first press arranged immediately upstream in the press line.

* * * * *